United States Patent [19]

Armstrong et al.

[11] Patent Number: 4,875,462

[45] Date of Patent: Oct. 24, 1989

[54] CAMPFIRE SMOKESTACK

[76] Inventors: Monroe A. Armstrong; Marty A. Armstrong, both of Star Rte. 1, Box 15-A, Weston, Colo. 81091

[21] Appl. No.: 251,731

[22] Filed: Oct. 3, 1988

[51] Int. Cl.[4] ..... F24C 1/16; F24C 15/08; F24C 15/16

[52] U.S. Cl. ..... 126/29; 126/9 R; 126/9 B; 126/58; 126/59; 126/304 R

[58] Field of Search ..... 126/9 R, 9 B, 29, 59.5, 126/59, 25 R, 304 R, 332, 275 R, 65, 1 R, 4, 27, 58, 500, 506, 519; 110/239; 99/467

[56] References Cited

U.S. PATENT DOCUMENTS

| | | | |
|---|---|---|---|
| 485,049 | 10/1892 | Marcee | 126/9 R |
| 634,609 | 10/1899 | Bredemeyer | 110/239 |
| 799,084 | 9/1905 | Pederson | 126/4 |
| 1,189,568 | 7/1916 | Hempy | 110/239 |
| 1,194,131 | 8/1916 | Brown | 126/29 |
| 1,298,762 | 4/1919 | Milligan | 126/9 B |
| 1,371,794 | 3/1921 | Leonard | 126/59 |
| 1,419,600 | 6/1922 | Anderson | 126/59 |
| 1,934,339 | 11/1933 | Winberg | 126/9 B |
| 2,573,772 | 11/1951 | Nysten | 126/59.5 X |
| 2,715,897 | 8/1955 | Newland et al. | 126/29 |
| 3,982,524 | 9/1976 | Diggs | 126/59.5 |

*Primary Examiner*—Carl D. Price

*Attorney, Agent, or Firm*—John E. Toupal; Harold G. Jarcho

[57] ABSTRACT

A smokestack including an elongated tube means having an open bottom end for receiving smoke emanating from a campfire and an open top end for releasing the smoke into the atmosphere, and a base for supporting the tube means with its open bottom end directly above the campfire and defining openings that provide physical and visual access thereto. The elongated tube comprises a plurality of tube sections distributed along a longitudinal axis and having ends joined to form a composite tube.

12 Claims, 1 Drawing Sheet

CAMPFIRE SMOKESTACK

BACKGROUND OF THE INVENTION

This invention relates generally to a smokestack, and more particularly, to a portable smokestack specifically suited for use with campfires.

Campers throughout the world commonly build wood fires that are used for both heating and cooking. Typically, a campfire is built either on the ground or in a rudimentary fireplace constructed of loose rocks found in the immediate area. Although providing essential needs of campers, the open campfire often exhibits highly undesirable traits. For example, wind blown smoke emanating from an open campfire frequently causes discomfort to a camper's eyes and lungs. In addition, wind blown sparks emitted from an open campfire can provide a serious fire hazard to both the camper and surrounding environment.

The object of this invention, therefore, is to provide an apparatus that will reduce the disadvantages inherently present in connection with the use of open campfires.

SUMMARY OF THE INVENTION

The invention is a smokestack including an elongated tube means having an open bottom end for receiving smoke emanating from a campfire and an open top end for releasing the smoke into the atmosphere, and a base for supporting the tube means with its open bottom end directly above the campfire and defining openings that provide physical and visual access thereto. The elongated tube comprises a plurality of tube sections distributed along a longitudinal axis and having ends joined to form a composite tube. When positioned over a campfire the smokestack prevents wind generated movement of smoke and sparks toward adjacent campers.

According to one feature of the invention, the tube sections comprise a top tube section defining the open top end and a plurality of longitudinally distributed lower tube sections, and each of the lower tube sections includes a support surface for disjointedly supporting a directly upwardly adjacent tube section. This arrangement facilitates assembly and dismantling of the smokestack.

According to another feature of the invention each of the tube sections is a hollow frustum, the lower tube sections comprise a bottom tube section defining the open bottom end and connected to the base and each of the other lower tube sections and the top tube section has a lower edge with an inner diamtter slightly greater than an outer diameter of an upper edge of a directly downwardly adjacent tube section such that each lower edge engages and is supported by an outer surface portion of a directly downwardly adjacent tube section. This feature permits nesting of the tube sections in a compact arrangement storage or transporting.

According to yet another feeature of the invention, the smokestack includes a cooking grate means disposed within the elongated tube and one of the tube sections defines a door for providing access to the grate. This arrangement permits additional use of the smokestack as a campstove.

According to still another feature of the invention, the elongated tube and the base have a combined length of at least five feet, and the open bottom end has a maximum width of at least two feet. These dimensions enhance the use of the smokestack as a protective director of campfire smoke.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
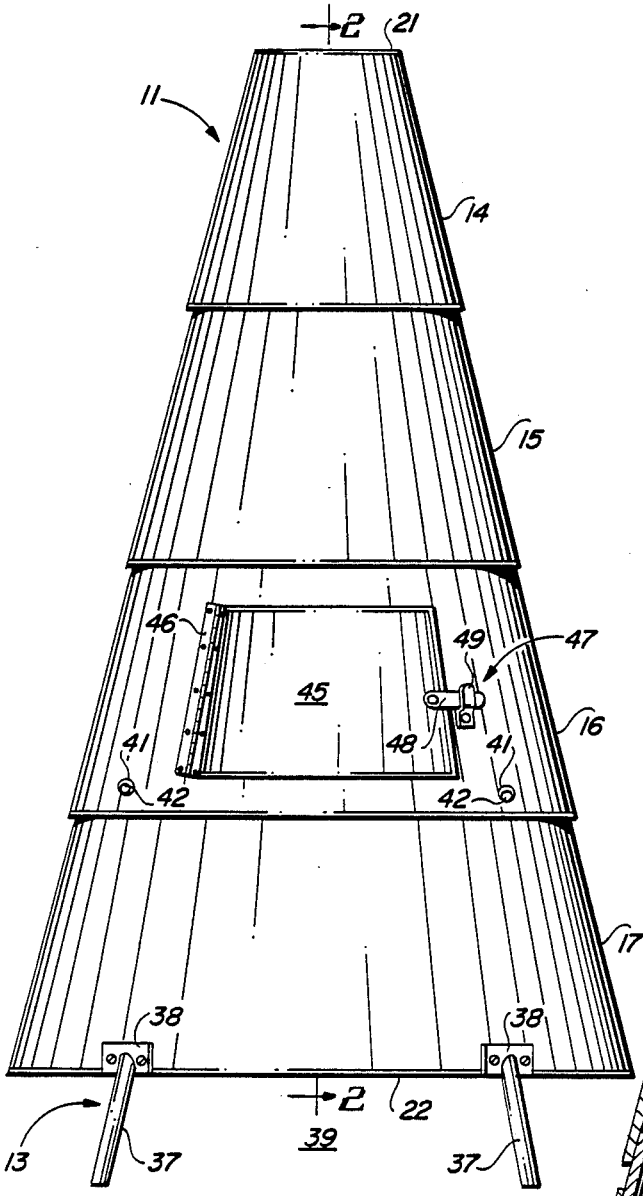
FIG. 1 is a front view of a smokestack constructed in accordance with the present invention.

A smokestack 11 includes an elongated tube 12 and a base 13 for supporting the tube 12 directly over an open campfire (not shown). The elongated tube 12 is composed of a plurality of longitudinally distributed tube sections including a top tube section 14 and lower tube sections 15–17 of which a bottom tube section 17 is supported by the base 13.

Figure 2:
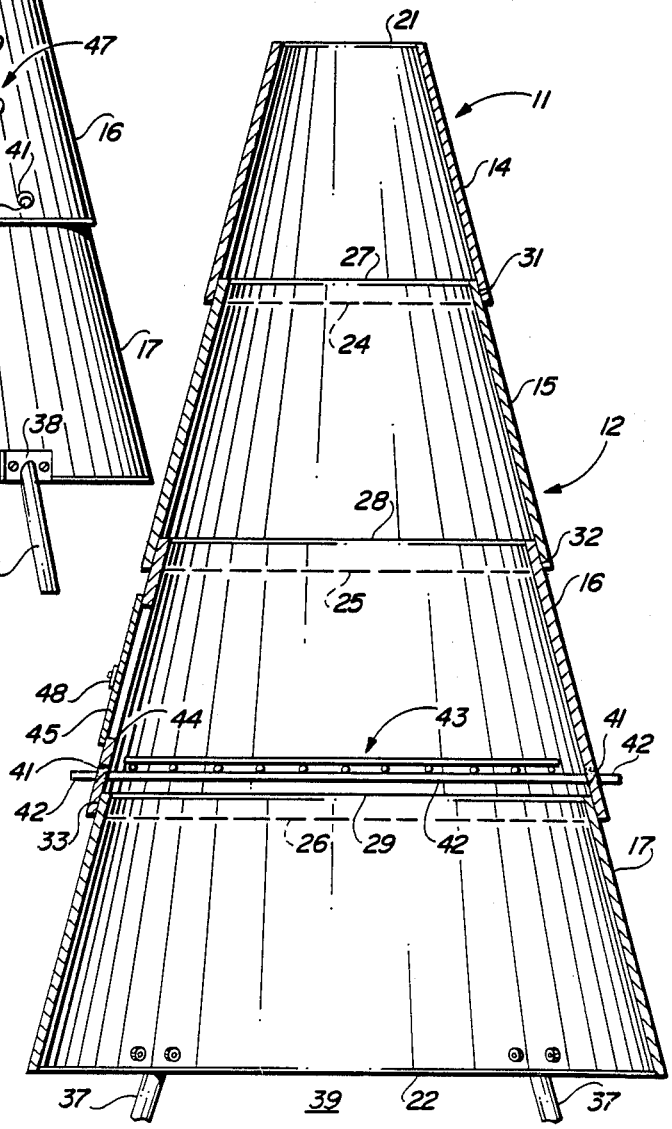
FIG. 2 is a cross-sectional view taken along lines 2—2 of FIG. 1.

Each of the tube sections 14–17 is in the form of a hollow right circular frustum with the top tube section 14 providing the elongated tube 12 with an open top end 21 and the bottom tube section 17 providing the elongated tube with an open bottom end 22. Preferably the tube sections 14–17 are constructed of a suitable heat resistant material such as sheet metal. As shown in FIG. 2 each of the upper tube sections 14–16 has a lower edge 24–26, respectively, with an inner diameter slightly greater than the outer diameter of an upper edge 27–29, respectively, of a directly downwardly adjacent tube section. Thus, outer and upper marginal portions 31–33 of the lower tube sections 15–17 form annular support surfaces 31–33, respectively, that engage and support inner skirt portions of the upper tube sections 14–16, respectively. Because of the disjointed platform support provided by the support surfaces 31–33, the elongated tube 12 is easily dismantled by simply separating the individual tube sections 14–17.

The base 13 comprises a plurality of legs 37 circumferentially distributed about the open bottom end 22 of the elongated tube 12. Secured to the upper end of each leg 37 is a bracket 38 that is bolted to a skirt portion of the bottom tube section 17 so as to be easily detachable therefrom. Openings 39 defined between adjacent legs 37 and a lower edge of the bottom tube section 17 provide both physical and visual access to a campfire positioned directly below the open end 22 of the elongated tube 12.

Extending through horizontally aligned holes 41 in lower portions of the intermediate tube section 16 are a pair of removable support rods 42. Supported by the rods 42 within the elongated tube 12 is a circular grate 43 that can be used for cooking. Slightly above the grate 43 is an opening 44 in the tube section 16 that provides access to items (not shown) supported by the grate 43. The opening 44 can be closed by a door 45 secured to the tube section 16 by a hinge 46. In a closed position, the door 45 can be secured by a latch assembly 47 including a latch arm 48 pivotally attached to the door 45 and a bracket 40 attached to the tube section 16.

During preferred use of the smokestack 11, the legs 37 first are bolted to a skirt portion of the bottom tube section 17 which is then positioned directly over a previously started campfire. Next, the intermediate tube section 16 is positioned on the annular support surface 33 of the bottom tube section 17 after which the rods 42 are inserted through the holes 41 and the grate 43 mounted thereon. Finally, the upper tube sections 15, 14 are sequentially mounted on the annular support surfaces 32, 31, respectively, completing assembly of the smokestack 11.

Sparks and smoke emanating from the campfire are received through the open end 22 and constrained by the elongated tube 12 before release into the atmosphere through the open top end 21. Thus, the smokestack 11 serves to prevent the wind from blowing either smoke or sparks toward campers inhabiting the region directly around a campfire covered by the elongated tube 12. In addition, after being heated by the campfire, the smokestack functions as a heat source that adds to the comfort of the campers. Conventional cooking operations can be performed on the grate 43 to which access is provided by the door 45. When a given camp site is to be abandoned, the smokestack 11 is easily dismantled in reverse order to the assembly steps described above. By nesting the frustum shaped tube sections 14–17, an extremely compact package is provided that can be efficiently stored or transported to a place of next use.

In a preferred embodiment, the combined height of the base 13 and the assembled elongated tube 12 is greater than five feet and preferably approximately six feet as to insure discharge of smoke above the head level of typical campers surrounding the campfire. Also, the lengths of the base legs 37 are greater than ten inches and preferably about thirteen inches so as to provide sizable openings 39 for accessing the campfire and the lower edge of the bottom section 17 has a diameter of at least two feet and probably about three feet so as to accommodate a campfire of reasonable size. An optimumly compact dismantled state of the smokestack 11 is preferably enhanced by the provision of individual tube sections 14–17 of substantially equal length.

Obviously, many modifications and variations of the present invention are possible in light of the above teachings. It is to be understood, therefore, that the invention can be practiced otherwise than as specifically described.

What is claimed is:

1. A smokestack for use with a campfire and comprising:

an elongated tube means having an open bottom end for receiving smoke emanating from a campfire and an open top end for releasing the smoke into the atmosphere, said tube means comprising a plurality of tube sections distributed along a longitudinal axis of said tube means and having ends joined to form a composite tube;

a base means for supporting said tube means with said open bottom end thereof directly above a campfire and defining openings that provide substantially unobstructed physical and visual access thereto thereby permitting both visual enjoyment of and addition of firewood to the campfire;

a cooking grate means for supporting food and disposed within said elongated tube means;

a door means defined in one of said tube sections for providing access to said grate means; and a plurality of rods, each extending through substantially horizontally aligned holes in one of said tube sections, and wherein said rods removably support said grate means.

2. A smokestack according to claim 1 wherein said tube sections comprise a top tube section defining said top end and a plurality of longitudinally distributed lower tube sections, and each of said lower tube sections comprises a support means for supporting a directly upwardly adjacent said tube section.

3. A smokestack according to claim 2 wherein each said support means disjointedly supports said directly upwardly adjacent tube section so as to facilitate separation thereof.

4. a smokestack according to claim 2 wherein each of said tube sections is a hollow frustum.

5. A smokestack according to claim 4 wherein said lower tube sections comprise a bottom tube section defining said bottom end and connected to said base means and each of said other lower tube sections and said top tube section has a lower edge with an inner diameter slightly greater than an outer diameter of an upper edge of a directly downwardly adjacent tube section such that each said lower edge engages and is supported by an outer surface portion of a directly downwardly adjacent tube section, said outer surface portions forming said support means.

6. A smokestack according to claim 1 wherein said tube sections comprise a top tube section defining said top end and a plurality of longitudinally distributed lower tube sections, and each of said lower tube sections comprises a support means for supporting a directly upwardly adjacent said tube section.

7. A smokestack according to claim 6 wherein each said support means disjointedly supports said directly upwardly adjacent tube section so as to facilitate separation thereof.

8. A smokestack according to claim 6 wherein each of said tube sections is a hollow frustum.

9. A smokestack according to claim 8 wherein said lower tube sections comprise a bottom tube section defining said bottom end and connected to said base means and each of said other lower tube sections and said top tube section has a lower edge with an inner diameter slightly greater than an outer diameter of an upper edge of a directly downwardly adjacent tube section such that each said lower edge engages and is supported by an outer surface portion of a directly downwardly adjacent tube section, said outer surface portions forming said support means.

10. A smokestack according to claim 9 wherein each of said frustums is right circular frustum.

11. A smokestack according to claim 10 wherein said base means comprises a plurality of legs attached to said bottom tube section.

12. A smokestack according to claim 1 wherein the combined length of said base means and elongated tube means is greater than five feet and said base means adapted to support said elongated tube means at least ten inches above a surface on which the campfire burns.

* * * * *